US010161701B2

(12) United States Patent
Paquette et al.

(10) Patent No.: US 10,161,701 B2
(45) Date of Patent: Dec. 25, 2018

(54) AMBIDEXTROUS MAGAZINE RELEASE

(71) Applicant: Battleline Industries, Inc., Littleton, CO (US)

(72) Inventors: Joshua Paquette, Littleton, CO (US); Douglas Brook, Wheat Ridge, CO (US); Jason Bohks, Wheat Ridge, CO (US); Tyler Crane, Wheat Ridge, CO (US)

(73) Assignee: Battleline Industries, Inc., Littleton, CO (US)

( * ) Notice: Subject to any disclaimer, the term of this patent is extended or adjusted under 35 U.S.C. 154(b) by 0 days.

(21) Appl. No.: 15/406,359

(22) Filed: Jan. 13, 2017

(65) Prior Publication Data

US 2017/0199000 A1 Jul. 13, 2017

Related U.S. Application Data

(60) Provisional application No. 62/278,378, filed on Jan. 13, 2016.

(51) Int. Cl.
*F41A 17/38* (2006.01)
*F41A 35/06* (2006.01)

(52) U.S. Cl.
CPC ..... *F41A 17/38* (2013.01); *F41A 35/06* (2013.01)

(58) Field of Classification Search
CPC ..... F41A 17/34; F41A 17/36; F41A 17/38
See application file for complete search history.

(56) References Cited

U.S. PATENT DOCUMENTS 4,539,770 A * 9/1985 Bornancini ..... F41A 35/06 42/7
2016/0069628 A1* 3/2016 Fluhr ..... F41A 17/38 42/6

FOREIGN PATENT DOCUMENTS

WO WO 2005/124263 * 12/2005

* cited by examiner

*Primary Examiner* — Stephen Johnson
(74) *Attorney, Agent, or Firm* — Dorsey & Whitney LLP

(57) ABSTRACT

An ambidextrous magazine release for a firearm is provided. The magazine release may include a release rod configured to be operably coupled to the firearm, and a lever operably connected to the release rod and rotatable relative thereto. A portion of the lever may be configured to engage a magazine received within the firearm. When a first force in a first direction is applied to the release rod, the release rod may move the lever to cause the lever to disengage the magazine. When a second force in a second direction is applied to the lever, the lever may rotate relative to the release rod to disengage the magazine.

17 Claims, 12 Drawing Sheets

AMBIDEXTROUS MAGAZINE RELEASE

CROSS REFERENCE TO RELATED APPLICATIONS

This application claims the benefit of priority under 35 USC § 119(e) of the earlier filing date of U.S. Provisional Patent Application No. 62/278,378 filed Jan. 13, 2016 and entitled "Ambidextrous Magazine Release," which is hereby incorporated by reference in its entirety.

FIELD

The present disclosure relates generally to firearm components, and more specifically to ambidextrous magazine releases for firearms.

BACKGROUND

Firearms, such as handheld pistols made by Glock and other manufactures, include reloadable and reusable magazines for holding ammunition. Each magazine holds a limited number of ammunition rounds and must be removed to be reloaded or replaced. Firearms that include a releasable magazine include a release component that allows the magazine to be removed or otherwise accessible to allow it to be replaced or reloaded. However, many firearms are designed specifically for right-handed users and include a magazine release button in an area that is easily accessible in the firing position for a right handed user. This allows a magazine to be quickly removed and replaced during combat or similar situations. While some firearm models allow the release component to be switched to the opposite side to allow easier access to the magazine release function for left handed shooters, most firearm models do not include a component that allows a shooter to use both their right hand and left hand to release the magazine in the shooting position

BRIEF SUMMARY

One embodiment of the present disclosure is an ambidextrous magazine release for a firearm. The release includes a release rod configured to be operably coupled to the handle of the firearm and a lever operably connected to the release rod and rotatable relative thereto. A portion of the lever is configured to engage a magazine received within the handle of the firearm. When a first force in a first direction is applied to the release rod, the rod moves the lever to cause the lever to disengage from the magazine and when a second force in a second direction is applied to the lever, the lever rotates relative to the release rod to disengage from the magazine. Thus, the release assembly can release in response to two different types of forces that may often be in opposite directions or applied from opposite sides of the firearm.

Additionally, the release may include one or more biasing elements, such as springs, that return the lever to an original position.

DETAILED DESCRIPTION

The present disclosure is related to an ambidextrous magazine release assembly or a magazine catch assembly for a firearm. The magazine release is configured to be operated by either the left hand or the right hand of the shooter. As compared to conventional magazine releases that are dedicated to either the left hand or the right hand, the magazine release assembly of the present disclosure can be used by either hand in the same installed orientation. That is, the magazine release allows full ambidextrous control during use. The release assembly is configured to interact with certain components of a factory installed magazine release and thus can be manufactured as an accessory for a firearm. Alternatively, the firearm can be manufactured with the release assembly as the original magazine release.

In one embodiment, the magazine release assembly includes a release rod, a lever rotatably connected to the release rod, and a biasing assembly connected to both the release rod and the lever. The lever includes an engagement feature, such as a tang, that engages the magazine when the magazine is received within the handle of the firearm. In this embodiment, in a first operation, the user directly actuates the lever, causing the lever to pivot about a hinge, disengaging a tang of the lever from the magazine. The biasing assembly then returns the lever to an original position after the user's force is removed. Alternatively, in a second operation, the user can actuate the actuator on a terminal end of the release rod, which causes the lever (that is secured to the release rod) to move with the rod to disengage the tang from the magazine. In this operation, a spring, such as the original factory installed spring in the firearm, biases the release rod to an original position, which moves the lever correspondingly, from the disengage position.

The lever is oriented so as to be actuated from a first side of the firearm and similarly the actuator of the release rod is oriented to be actuated from a second side of the fire arm.

In embodiments described herein the magazine release assembly is configured to be used with a Glock pistol, such as one described in U.S. Pat. No. 4,825,744 and commercial produced pistols by Glock, Inc. (all Glock pistols generations and models, e.g., Generations 1-4). In these embodiments, the spring and/or other components of the original magazine release are modified to engage with the release assembly of the present disclosure.

Figure 1:
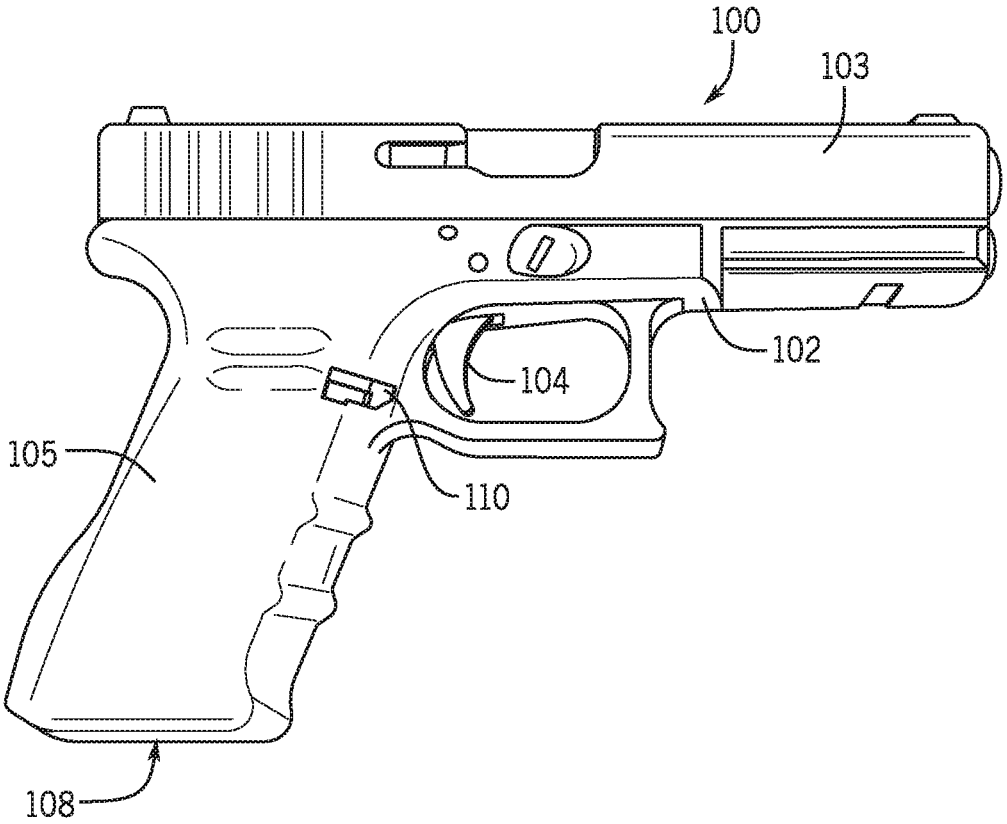
FIG. 1 is side elevation view of a firearm.
Figure 2A:
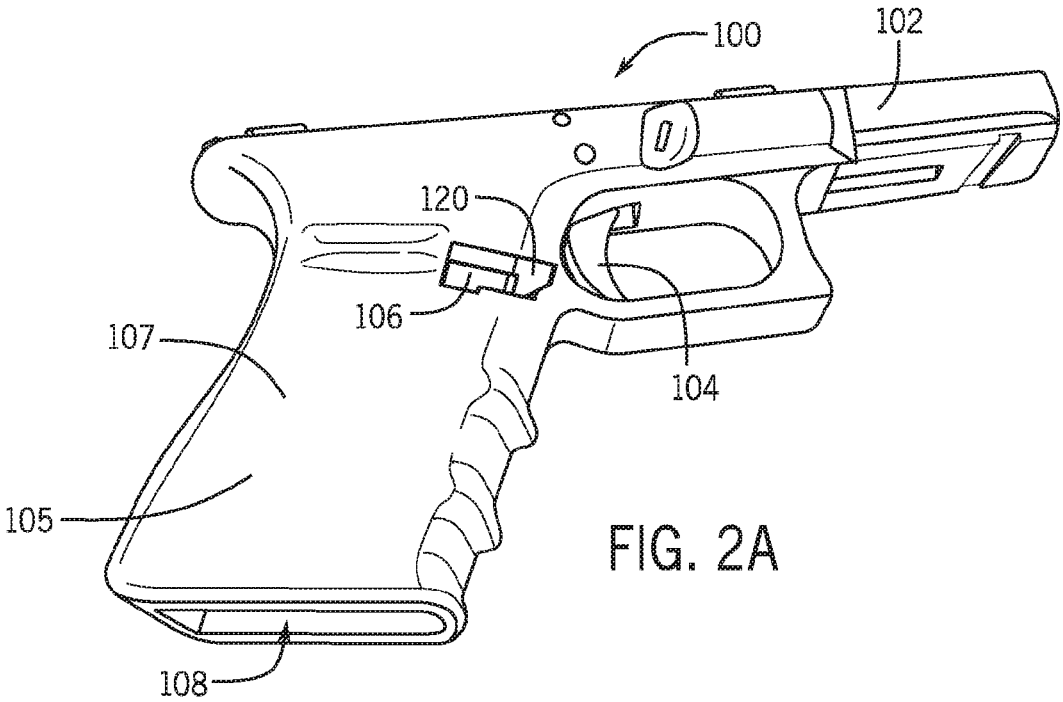
FIG. 2A is a right side elevation view of the firearm of FIG. 1 with a magazine release assembly installed.
Figure 2B:
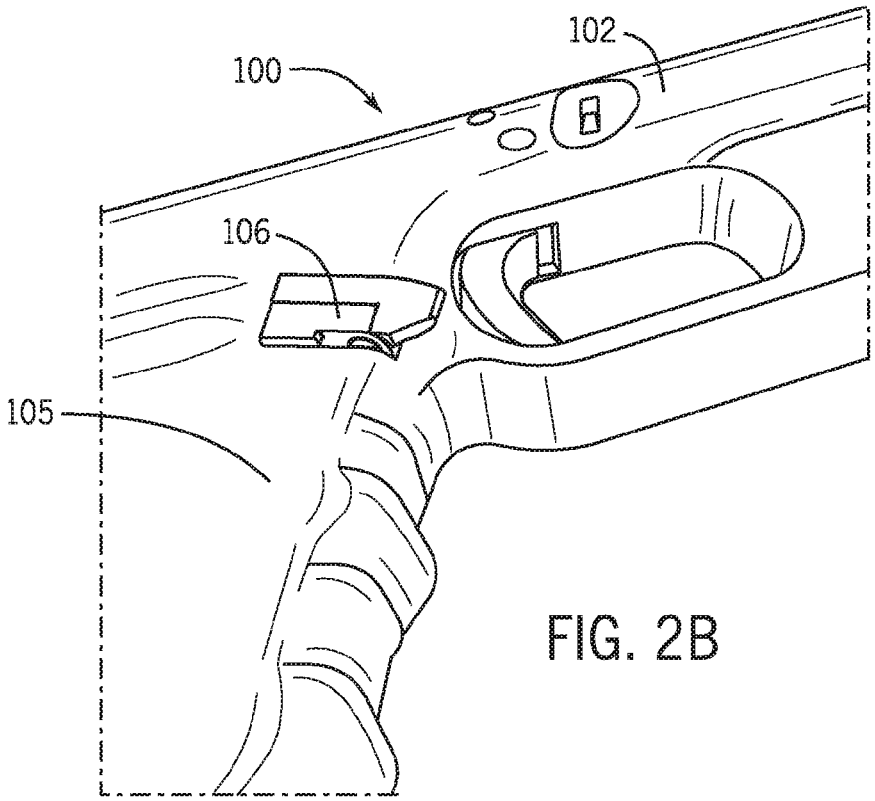
FIG. 2B is an enlarged view of the firearm of FIG. 2A.
Figure 3:
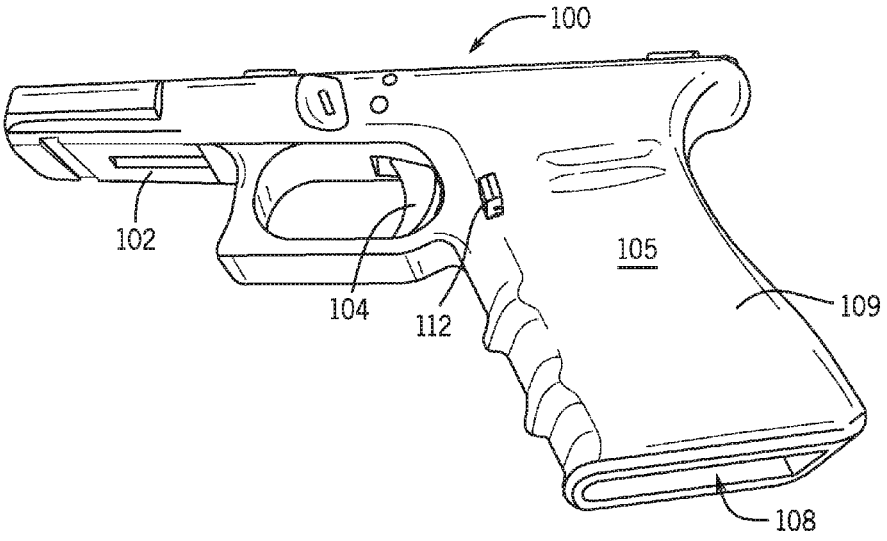
FIG. 3 is a left side elevation view of the firearm of FIG. 2A.

Turning to the figures, the release assembly and corresponding operation with a firearm will be discussed in more detail. FIG. 1 is a right side elevation view of an example of a firearm 100 for use with the magazine release assembly. As shown in FIG. 1, the firearm 100 includes a handle 105, a frame 102, a slide 103, a trigger 104, a magazine cavity or magazine well 108, and a cavity access port 110. The magazine well 108 may be defined within the handle 105 and is configured to receive a magazine 127 (see FIG. 10) holding ammunitions therein. The access port 110 (which as shown in FIG. 1 includes a protective cover) may be defined through the right and left sides of the handle 105 to allow access into the magazine well 108 and is configured to receive a release assembly for releasing the magazine. FIGS. 2A-3 illustrate various views of the firearm 100 with a magazine release assembly 106 installed. (Note: FIGS. 2A-3 illustrate the firearm 100 with the slide 103 removed). As shown in FIGS. 2A-3, the magazine release assembly 106 extends from a first side 107 of the handle 105 through the handle 105 to a second side 109. This allows the magazine release assembly 106 to be accessed by a user from either side of the handle 105 (e.g., from either the first side 107 or the second side 109 of the handle 105).

Figure 4A:
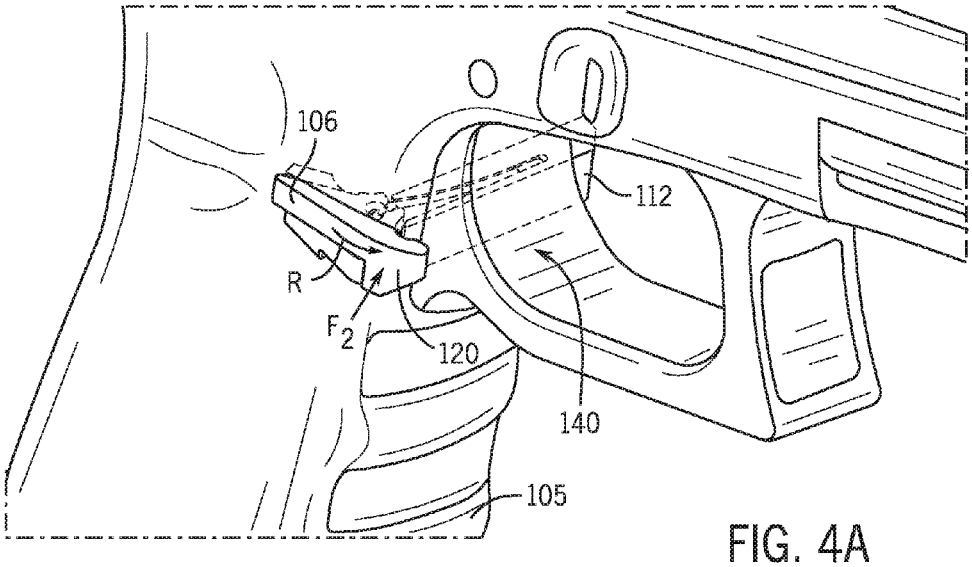
FIG. 4A is an illustration of the firearm of FIG. 2A with certain elements in partial transparency.
Figure 4B:
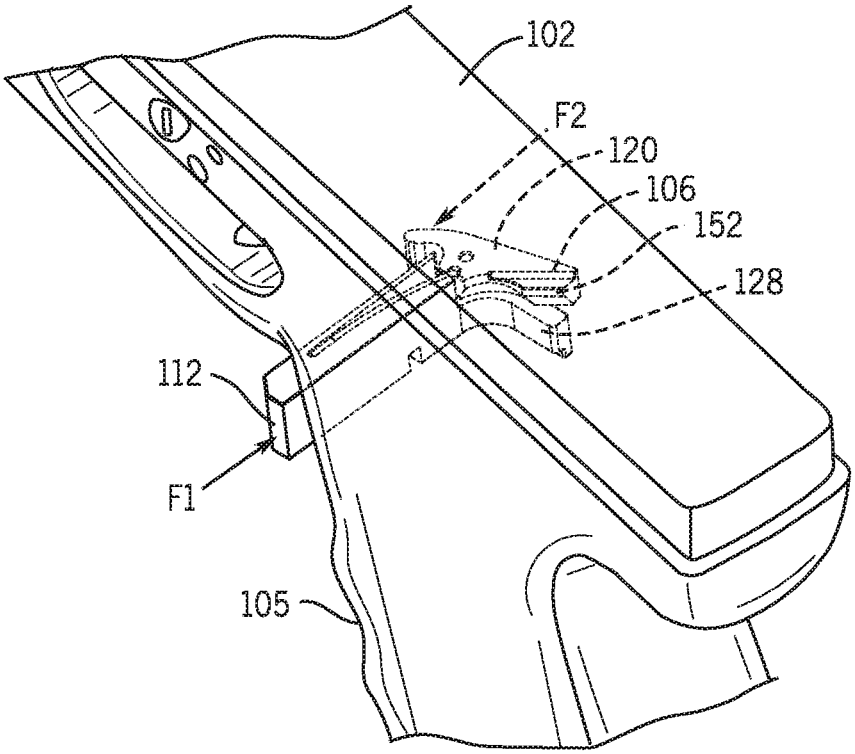
FIG. 4B is an illustration similar to FIG. 4A but taken from a different vantage point.

FIGS. 4A and 4B illustrate the firearm 100 with the magazine release assembly 106 installed and with the firearm 100 being partially transparent for illustrative purposes. As shown in FIGS. 4A and 4B, the magazine release assembly 106 is received in a track 140 or channel defined by an interior surface of the handle 105 within the magazine well 108. The magazine release assembly 106 extends from the first side 107 along the track 140 to exit the second side 109 of the handle 105. In this configuration, opposing portions of the magazine release assembly 106 (e.g., a lever and an actuation surface, as explained below) are accessible from the first side 107 and second side 109, respectively.

Figure 5A:
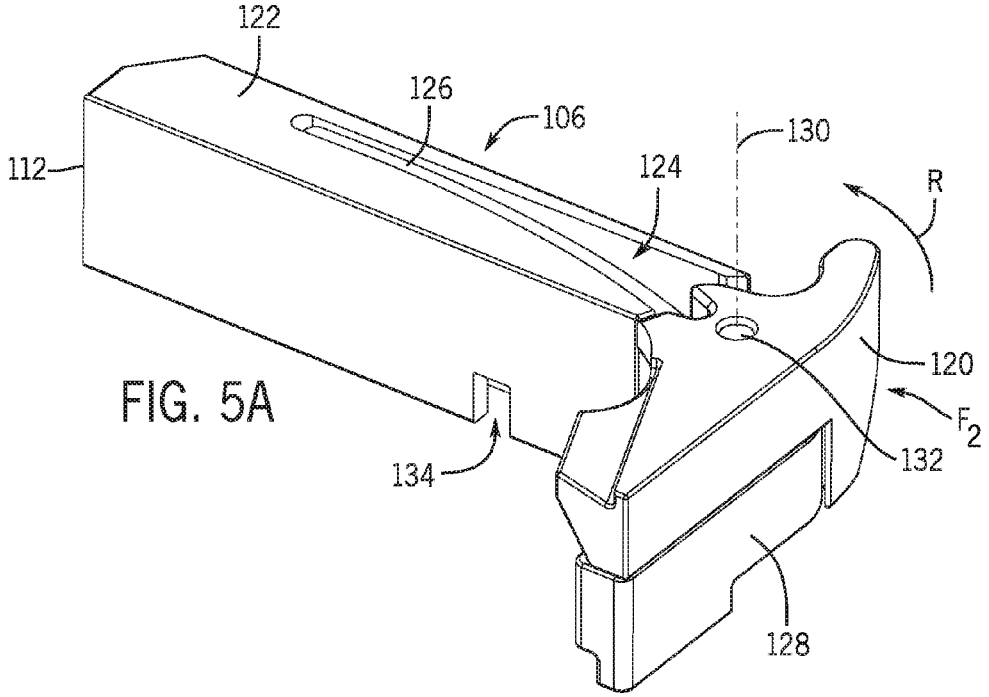
FIG. 5A is a top perspective view of the magazine release assembly removed from the firearm.
Figure 5B:
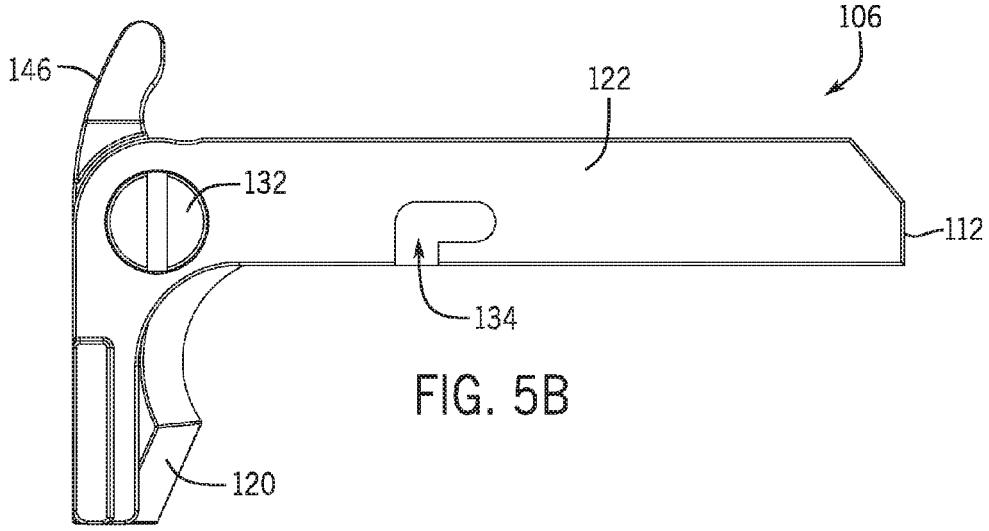
FIG. 5B is a bottom plan view of the magazine release assembly of FIG. 5A.
Figure 6:
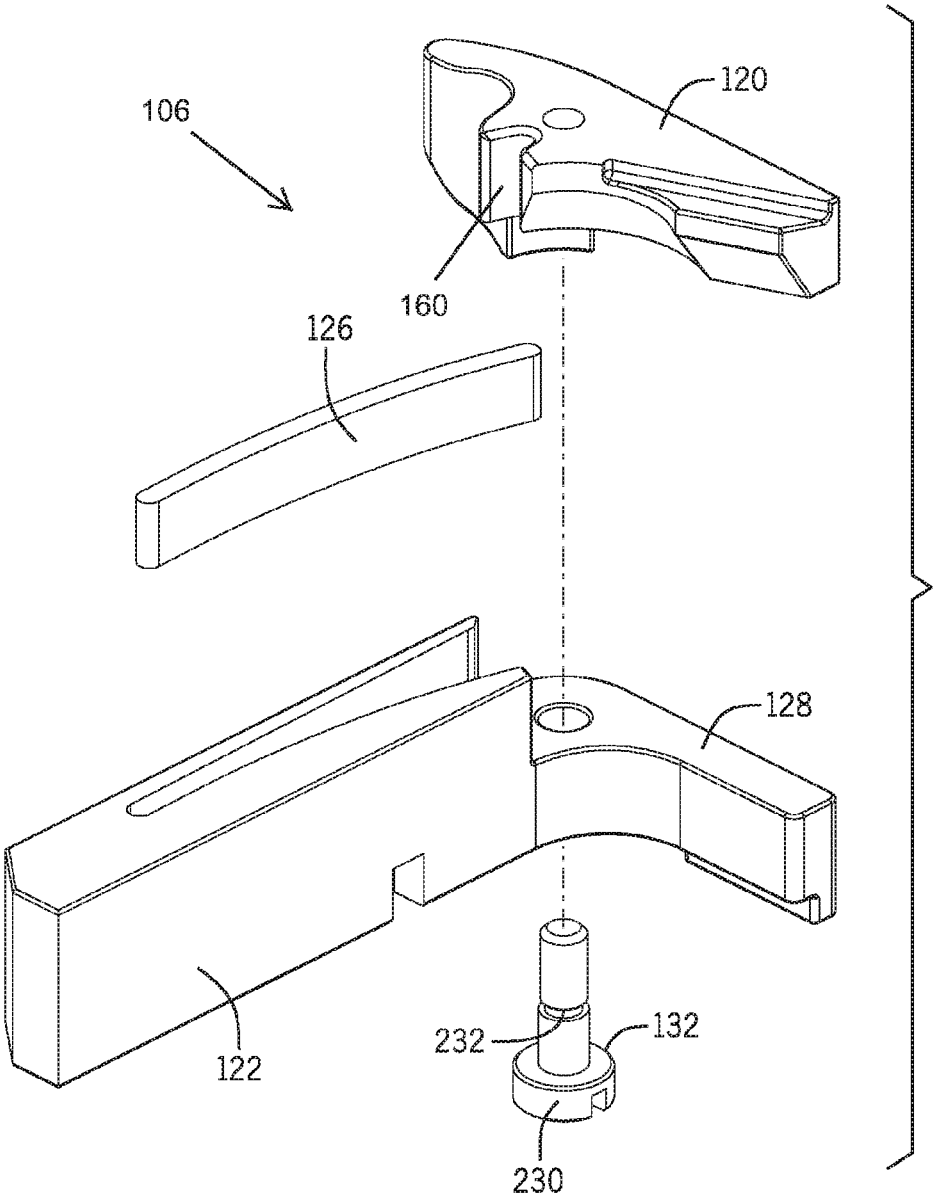
FIG. 6 is an exploded view of the magazine release assembly of FIG. 5A.

The magazine release assembly 106 or magazine catch assembly will now be discussed in more detail. FIGS. 5A-6 illustrate various views of the magazine release assembly 106. With reference to FIGS. 5A-6, the magazine release assembly 106 includes an actuating element (e.g., a lever 120 for the sake of convenience and without intent to limit), a biasing member 126, a release rod 122, and a fastener 132. The lever 120 or actuating element is hingedly connected to the release rod 122 to allow the lever 120 to pivot about a rotation axis 130 to rotate relative to the release rod 122. Additionally, the fastener 132 rigidly secures the lever 120 to the release rod 122, such that certain movements (e.g., lateral movements) of the release rod 122, such as due to a force exerted on the actuation surface 112, will cause the lever 120 to move correspondingly to release the magazine 127, as will be discussed in more detail below. Each of the components of the magazine release assembly 106 will be discussed in turn.

Figure 7A:
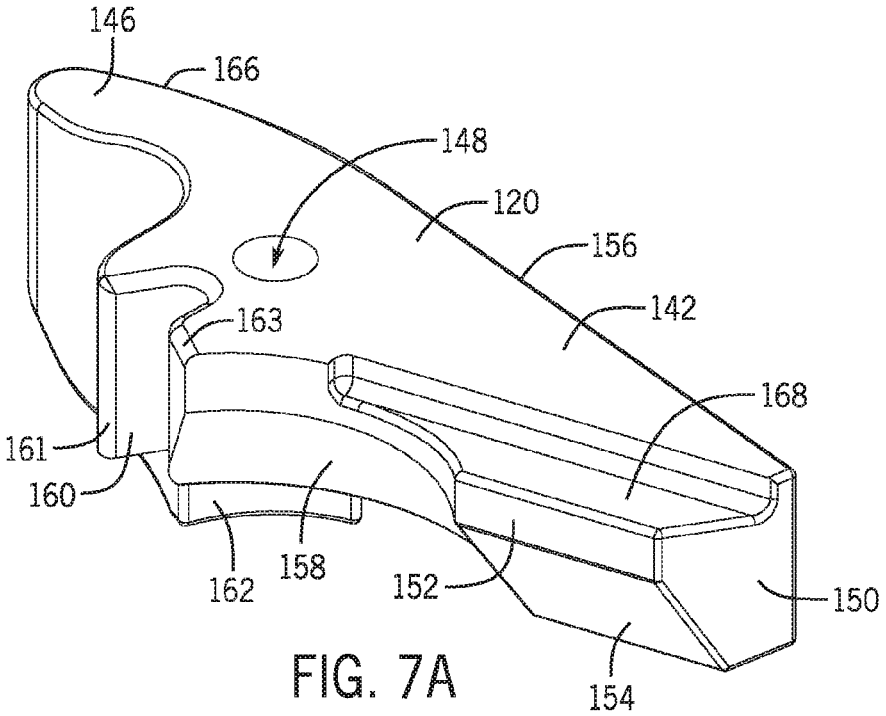
FIG. 7A is a top perspective view of a lever of the magazine release assembly of FIG. 5A.
Figure 7B:
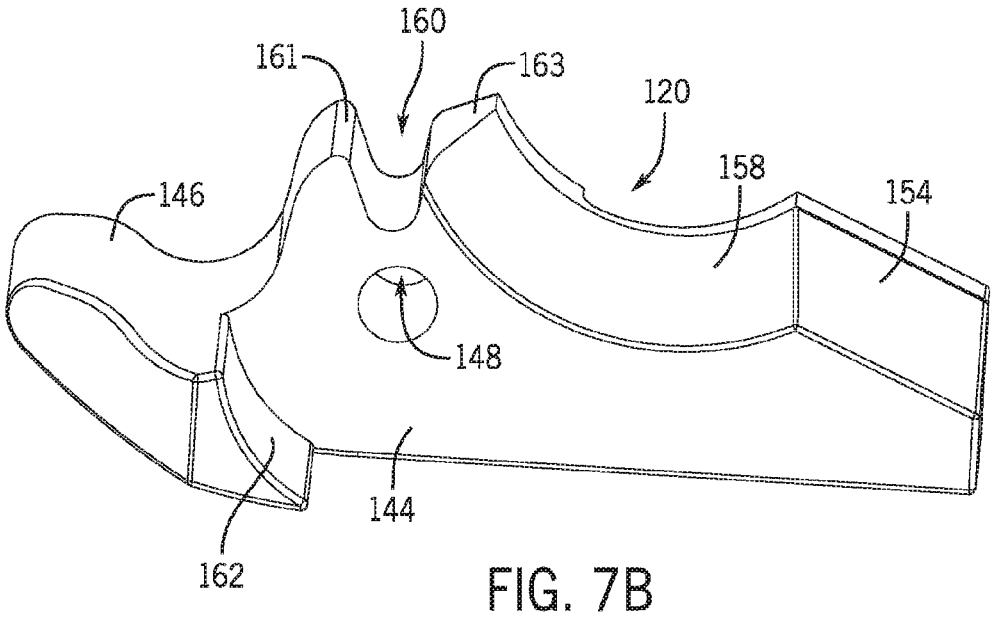
FIG. 7B is a bottom perspective view of the lever of FIG. 7A.
Figure 7C:
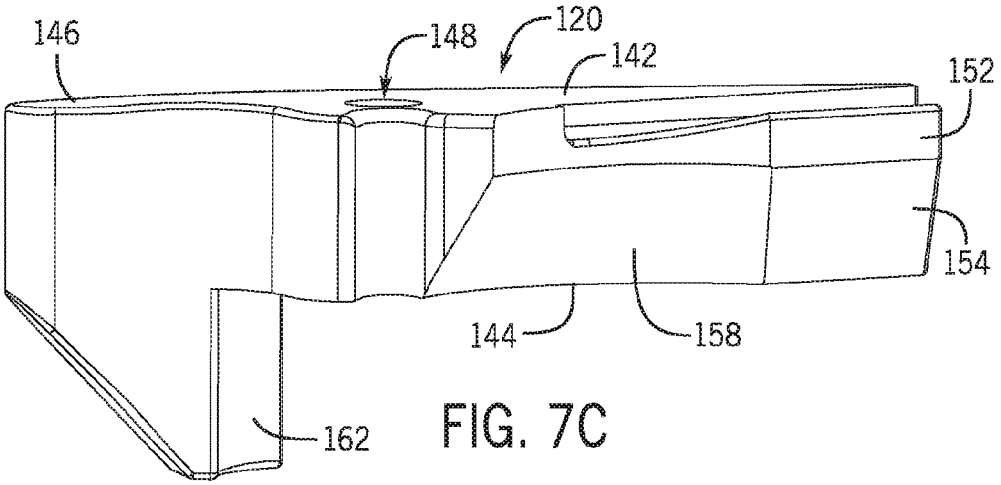
FIG. 7C is a side elevation view of the lever.

FIGS. 7A-7C illustrate various views of the lever 120. With reference to FIGS. 7A-7C, the lever 120 may be formed as an integral body including a top surface 142 and a bottom surface 144. An exterior surface 156 extends between the top and bottom surfaces 142, 144 and forms a sidewall of the lever 120. The exterior surface 156 is configured to be positioned outside of the handle 105 when attached to the firearm 100. In some embodiments, the exterior surface 156 follows the curvature of the handle 105 and so may include a curved surface 166 having a curvature that substantially follows or otherwise corresponds to the curvature of the handle 105. The curved surface 166 also defines a finger 146 that defines a first end of the lever 120. The finger 146 is shaped as an elongated protrusion that can be actuated by a user. As such, in some embodiments, the curved surface 166 and/or other areas of the finger 146 can include a texture or other gripping surface that assists a user in actuating the component, as well as to use tactile feel to determine the location of the component.

From the finger 146, the body curves downward and forms a catch 160 on a second side of the lever 120. The catch 160 is defined as a grooved channel formed between two lobes 161, 163 and is configured to secure an end of the biasing member 126. After the second lobe 163 the lever 120 transitions to a second sidewall defining an interior surface 158. The interior surface 158 may be curved to substantially match the interior contours of the magazine well 108 (see FIG. 4B). As such, depending on the type of firearm 100, the curvature of the interior surface 158 may vary.

After the interior surface 158, the interior sidewall of the lever 120 transitions to define a tang 150. The tang 150 is configured to selectively engage a magazine received within the magazine well 108 and as such may be modified in shape and/or dimension based on the type of magazine used with the firearm 100. In some embodiments, the tang 150 includes a protruding relatively vertical engagement surface 152 that extends into the magazine well 108 (see FIG. 4A) and is configured to be received within a notch or catch defined in the outer surface of the magazine. The engagement surface 152 thus acts as a detent that engages the magazine to secure the magazine in position. From the engagement surface 152, the tang 150 extends to a transition surface 154 that forms a chamfered or beveled surface and is angled downward and towards the outer surface 156 of the lever 120. The angle of the transition surface 154 is selected to allow the engagement surface to smoothly engage and disengage from the magazine and help to prevent the engagement surface from sticking against the magazine, preventing disengagement. Further, the transition surface 154 allows the magazine to more easily engage the engagement surface 152 when being inserted into the magazine well 108. For example, the magazine can travel along the angled surface 154 to push the lever 120 outwards until the catch or groove aligns with the engagement surface 152.

With continued reference to FIGS. 7A-7C, the lever 120 also includes a step 168 defined as a recessed area on the top surface 142 of the lever 120. The step 168 is recessed to allow the lever 120 to fit within the port 110 defined in the handle 105 and reduces the thickness of a portion of the lever 120 to allow the lever 120 to pivot unobstructed relative to the handle 105. The top surface of the lever 120 also defines a fastening aperture 148 that extends through the lever 120 and between the top and bottom surfaces 142, 144. The fastening aperture 148 is configured to receive the fastener 132.

The lever 120 also includes a pivot surface 162 that extends downward from the bottom surface 144. The pivot surface 162 is a curved extension having a curvature radius that substantially matches the curvature of the release rod 122. The pivot surface 162 engages the outer surface 191 of the release rod 122 to allow the lever 120 to pivot relative thereto. The pivot surface 162 also functions as an alignment surface and helps to align the lever 120 with the release rod and secure the lever 120 in the proper configuration relative to the release rod 122.

The release rod 122 will now be discussed in more detail. FIGS. 8A-8D illustrate various views of the release rod 122. The release rod 122 or main body of the assembly engages with the lever 120 and the original magazine release structure of the firearm 100 to release the magazine when actuated. With reference to FIGS. 8A-8D, the release rod 122 is a generally L shaped member having a main elongated body 181 with a support platform 128 extending outwards from a first end of the body 181. The main body 181 includes a biasing housing 180 that extends along the length of the body 181. A biasing cavity 124 is defined within the biasing housing 180 and is a channel or groove that extends longitudinally along a length of the body 181. The biasing cavity 124 is configured to receive the biasing member 126 and may be modified based on the desired biasing force and the type of biasing member used. In on embodiment, the biasing cavity 124 has a straight portion that widens out to define a mouth towards the end of the main body 181. As will be discussed in more detail below, the increased diameter of the biasing cavity 124 allows the biasing member 126 to move within a predefined track, such that the biasing member 126 can move, but in a restricted manner.

The actuator 112 is defined as a terminal end 202 and a beveled edge 204 that form the end of the release rod 122. The terminal end 202 may be shaped and dimensioned to function as a button to receive a user input to actuate the release rod 122. The beveled edge 204 provides increased comfort, increases the ease of inserting the firearm 100 into a holsters, reduces sharp edges, allows the assembly 106 to be installed easier as it can more easily slip behind the factory spring easily, and enhances the aesthetics. As with the lever 120, the actuator 112 may include a textured or other gripping surface formed integrally therewith or applied thereto to enhance the feel of the actuator 112 and assist a user in actuating the button.

Figure 8A:
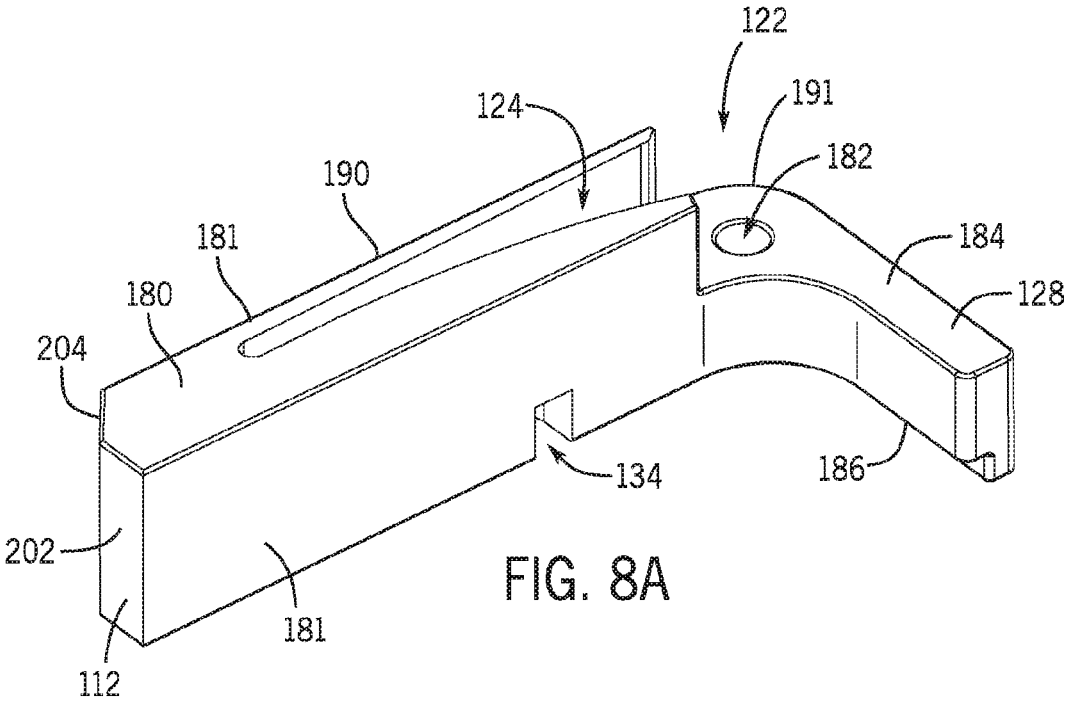
FIG. 8A is a top perspective view of a release rod of the magazine release assembly of FIG. 5A.
Figure 8B:
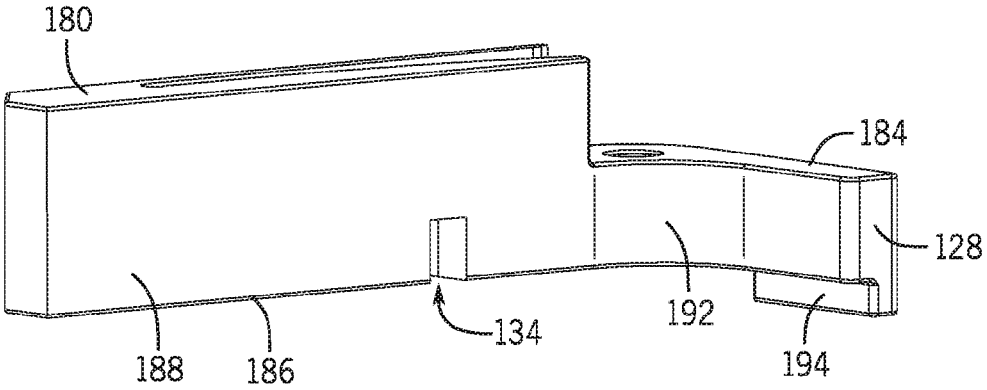
FIG. 8B is a side elevation view of the release rod of FIG. 8A.
Figure 8C:
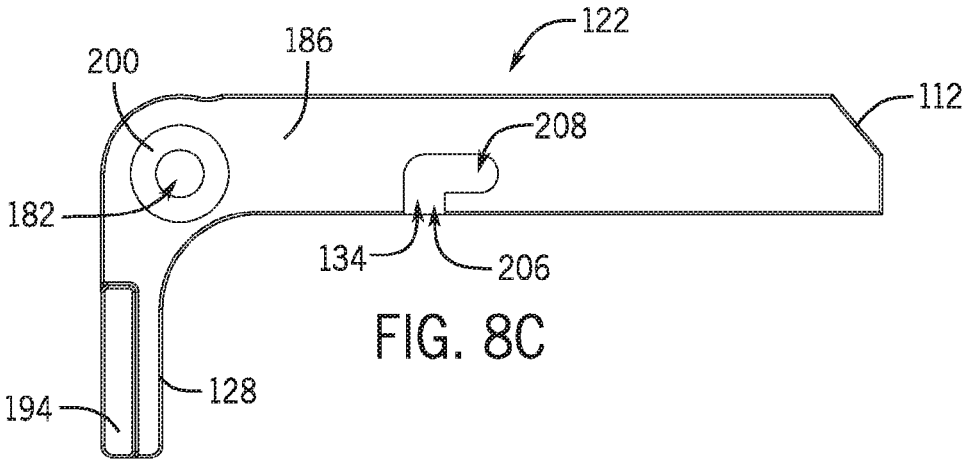
FIG. 8C is a bottom plan view of the release rod of FIG. 8A.
Figure 8D:
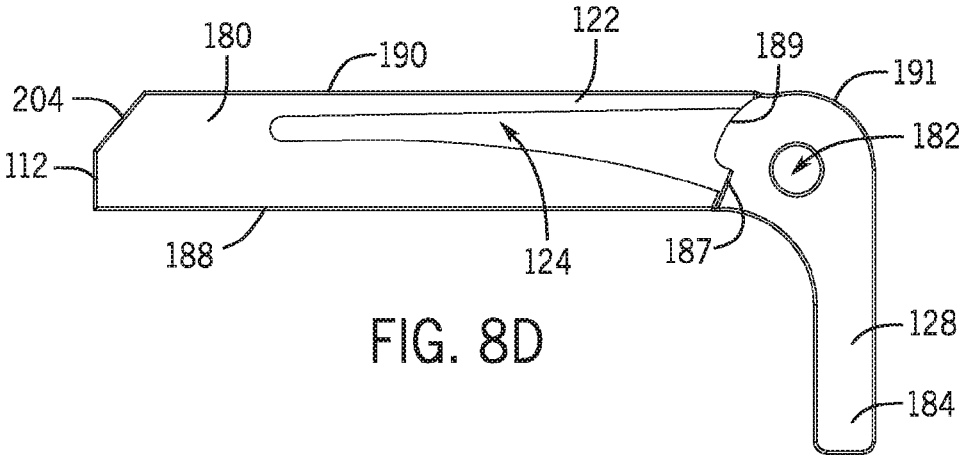
FIG. 8D is a top plan view of the release rod of FIG. 8A.

A spring channel 134 is defined through the bottom surface 186 and a portion of the main body 181 of the release rod 122. With reference to FIG. 8C, the spring channel 134 is L shaped channel with a shallow entrance 206 defined on the interior sidewall of the main body 181 and an elongated section 208 formed at approximately a right angled relative to the entrance portion. The elongated section 208 extends along a portion of the length of the main body 181. The spring channel 134 is configured to receive a release spring, such as the spring forming a part of the manufactured installed magazine release, and is secured to the handle 105 in the magazine well 108. For example, the spring may be a thin wire or coil spring that extends along the length of the handle 105 and is secured to an interior surface of the handle 105. As will be discussed in more detail below, the installed spring is received into the spring channel 134 to secure the release rod 122 to the handle 105 and allow the spring to exert a biasing force on the release rod 122.

With continued reference to FIGS. 8A-8D, the support platform 128 extends at an angle relative to the main body 181. The support platform 128 is stepped down in height as compared to the top surface of the biasing housing, such that the top surface 184 of the support platform 128 is below the top surface of the biasing housing 180. A fastening aperture 182 is defined through the support platform 128 and is positioned at the webbing between the support platform 128 and the main body 181. The fastening aperture 182 is configured to receive the fastener 132 and may be varied as desired. As shown in FIG. 8C, the fastening aperture 182 may also include a ledge 200 on one end of the aperture 182 to seat the head of the fastener 132, receive a nut, or the like.

The support platform 128 may also include an exterior wall 194 that extends downwards from the bottom surface 186. The exterior wall 194 is configured to be positioned outside of the handle 105 of the firearm 100 and helps to align and position the release rod 122 within the magazine well 108.

With reference to FIG. 8C, in some embodiments, the release rod 122 may also include one or more stops 187, 189. The stops 187, 189 may be defined as one or more side edges of the biasing housing 180. The stops 187, 189 are configured to engage with components of the lever 120 to direct the movement of the lever 120, as well as to prevent over rotation of the lever 120.

With reference to FIG. 6, the release assembly 106 also includes the fastener 132. The fastener 132, which may be a screw, a pin, or any other fastening component, defines an axis of rotation 130 for the lever 120. In some embodiments, the fastener 132 rigidly secures the lever 120 to the release rod 122. The fastener 132 may be varied as desired, but in one embodiment includes a shaft having an annular grove 232 and a head 230 defined at a terminal end of the shaft. However, as should be appreciated, numerous other types of fastening components may be used, and the fastener 132 shown in FIG. 6 is just one example.

With continued reference to FIG. 6, the release assembly 106 also includes the biasing member 126. The biasing member 126 exerts a biasing force against the lever 120 to return the lever 120 to an initial position. The biasing member 126 may be substantially any type of component configured to exert a force or deform to exert a force. Some examples of the biasing member 126 include a flat bar, a wire spring, a leaf spring, a deformable resilient component, or the like. The biasing member 126 may be formed integrally with the lever 120 or the release rod 122 or be formed as a separate component. Further, the biasing member 126 may include two or more elements, such as two or more springs, where the biasing force is the total force exerted by each of the components.

Assembly of the release assembly 106 will now be discussed in more detail. With reference to FIGS. 5A and 6, the biasing member 126 is positioned within the biasing channel 124 of the release rod 122. In embodiments where there may be two biasing members, the first one is inserted first into the channel and the second is inserted on top of and parallel to the first member. The biasing member 126 extends longitudinally along the length of the biasing cavity 124. A terminal end of the biasing member 126 (or ends of two biasing members) are received within the catch 160 of the lever 120, to secure them to the lever 120. It should be noted that the biasing member 126 may be secured to the lever 120 before or after it is positioned within the biasing cavity 124. The terminal end of the biasing member 126 is clamped within the catch 160, such that movement of the lever 120 will exert a force on the biasing member 126.

The lever 120 is then connected to the release rod 122. Specifically, referring to FIGS. 7A-8A, the lever 120 is positioned on the support platform 128 such that the fastening aperture 148 on the lever 120 aligns with the fastening aperture 182 in the release rod 122. In this configuration, the interior surface 158 substantially aligns with the curved interior corner of the support platform 128. The bottom surface 144 of the lever 120 interfaces with the top surface 184 of the support platform 128. The finger 146 of the lever 120 extends past the end of the support platform 128 with the pivot surface 162 being positioned on an outer corner 191 of the release rod 122.

The fastener 132 is then received into the fastening aperture 182 in the release rod 122 and into the fastening aperture 148 of the lever 120 to secure the two components together. In embodiments where the fastener 132 includes a head 240, the head 240 seats against the ledge 200 defined within the fastening aperture 182 of the release rod 122. Additionally, as shown in FIG. 5A, in some embodiments, the fastener 132 may be selected so that it terminates prior to reaching the top surface 142 of the lever 120. In other words, the end of the fastener 132 may be recessed relative to the top surface 142 to help ensure that the fastener 132 does not interfere with or engage the handle 105 or other areas of the firearm 100 that could affect movement of the assembly 106.

Figure 9:
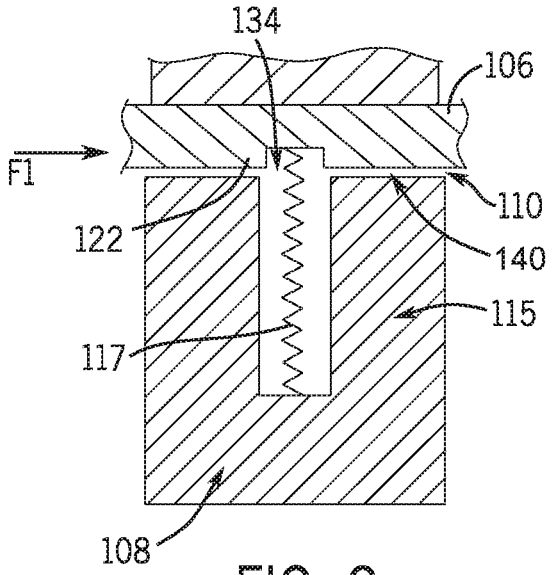
FIG. 9 is a simplified cross section view illustrating of the firearm of FIG. 2A.

Once the release assembly 106 is connected it can be inserted into the firearm 100. FIG. 9 is a simplified cross-section view of the firearm 100 with the release assembly 106 connected thereto. With reference to FIGS. 2A, 3, and 9, the release rod 122 is inserted into the port 110 defined on the outer surface of the handle 105, the actuator 112 extends into track 140 defined in the interior surface 115 of the magazine chamber 108. The actuator 112 extends outwards from the track 140 past the outer surface 109 of the handle 105. Once the release rod 122 is positioned in the track 140, the user connects the release assembly 106 to the release spring 117 of the firearm 100. In particular, the top end of the release spring 117 is inserted into the spring channel 134. Additionally, the exterior wall 194 of the release rod 122 is positioned on the external surface of the first side 107 of the handle 105. This helps to align the release assembly 106 and assist in keeping the release assembly 106 in position during actuation of the assembly 106.

Figure 10:
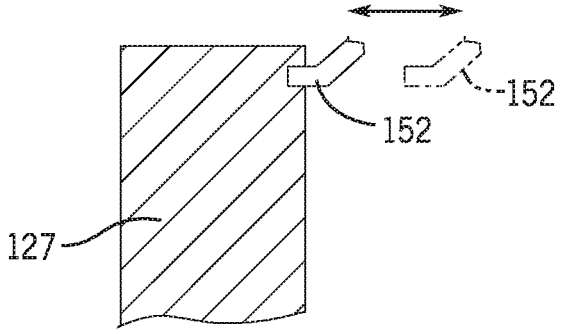
FIG. 10 is a simplified cross section view of a magazine engaging the magazine release assembly of FIG. 5A.
Figure 11:
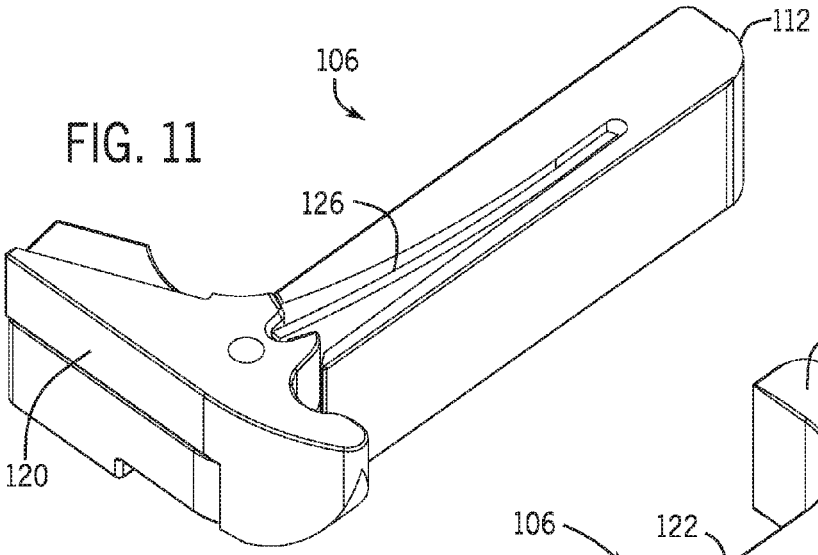
FIG. 11 is a perspective view of an additional magazine release assembly.

Operation of the release assembly will now be discussed in more detail. With reference to FIG. 3, 5A, and 9, when a user exerts a first force in a first direction, force F1 on the actuator 112, the force F1 causes the release rod 122 to move laterally within the track 140 in the handle 105. The force F1 also causes the spring 117 to deform or extend as it moves with the release rod 122. As the release rod 122 moves, the lever 120, which is connected to the release rod 122 via the fastener 132, moves laterally therewith. With reference to FIG. 10, as the lever 120 moves, the engagement surface 152 of the lever 120 moves outwards from the interior of the magazine well 108 and disengages from the outer surface of the magazine 127 and/or groove defined on the magazine. This disengagement allows the magazine 127 to release from the firearm 100 and be removed from the cavity 108. Once the user force F1 is removed or reduced below the biasing force of the spring 117, the spring 117 exerts a biasing force against the release rod 122 to move the rod in the opposite direction. In other words, the spring 117 returns the release rod 122 to the original position from the disengagement position.

With reference to FIG. 4A and 5A, when a user exerts a second force in a second direction, second force F2 against the finger 146 of the lever 120 on the first side 107 of the firearm 100, the force F2 causes the lever 120 to rotate in the rotation direction R. The lever 120 rotates about the rotation axis 130 defined by the fastener 132 that acts as a hinge for the lever 120. As the lever 120 rotates, the engagement surface 152 is pivoted outwards away from the magazine 127. This disengages the lever 120 from the magazine 127, allowing the magazine 127 to be removed. The force F2 overcomes the biasing force exerted by the biasing member 126 to allow the lever 120 to rotate relative to the release rod 122. Once the user force F2 is removed, the biasing member 126 exerts the biasing force on the lever 120 to cause the lever 120 to pivot back to the original position.

Additionally, during rotation of the lever 120 to the disengaged position, the lobes 161, 163 defining the catch 160 may engage one or both of the stops 187, 189 of the release rod 122. For example, as the lever 120 rotates and reaches a predetermined position, the first lobe 161 abuts against the stop 187 to prevent further rotation of the lever 120. In this example, the first stop 189 defines a track for movement of the lever 120 relative to the release rod 122. It should be noted that the stops may be varied as desired based on the shape of the lever 120, the degree of movement desired, and the configuration of the firearm 100.

The release assembly 106 allows a user to disengage and release the magazine 127 from either side 107, 109 of the handle 105. This provides full ambidextrous release capabilities to a user and does not require the release assembly 106 to be reinstalled in a particular orientation to allow right or left hand usage. That is, when installed, the release assembly 106 can release the magazine 127 from either side of the handle 105. This release ability provides more flexibility and control to the user during combat situations, includes a universal fit for both right and left handed users, and accommodates user preferences and body limitations (e.g., missing or shorter fingers on a particular hand).

In some embodiments, the release assembly 106 may be shaped and sized depending on the particular application (e.g., depending on the dimensions of the particular firearm). For example, the release rod 122 may be dimensioned to accommodate a wider or narrower handle 105. In some embodiments, the lever 120 and/or the actuator 112 may conform to the shape and/or dimensions of the handle 105. Additionally or alternatively, the lever 120 and/or the actuator 112 may be shaped to achieve a desired tactile feel for a user. For example, the terminal end 202 of the actuator 112 may include a button 300 extending away from the release rod 122 to define an enlarged surface to receive a user input (see FIGS. 12 and 13). In such embodiments, the button 300 may be arranged to increase tactile feel to a user, such as by providing an enlarged gripping surface. The button 300 may be flat (see FIG. 12) or may curve outwardly to define a bump, hump, or ridge 320 (see FIG. 13) depending on the desired amount of tactile feel. For example, a flat button, such as the button 300 shown in FIG. 12, may present a smooth transition between the handle 105 and the release assembly 106. A raised button, such as the button 300 shown in FIG. 13, may present an increased transition between the handle 105 and the release assembly 106 to facilitate a user locating the release assembly 106 during training, shooting, or combat situations (e.g., more easily, more quickly, etc.).

Figure 12:
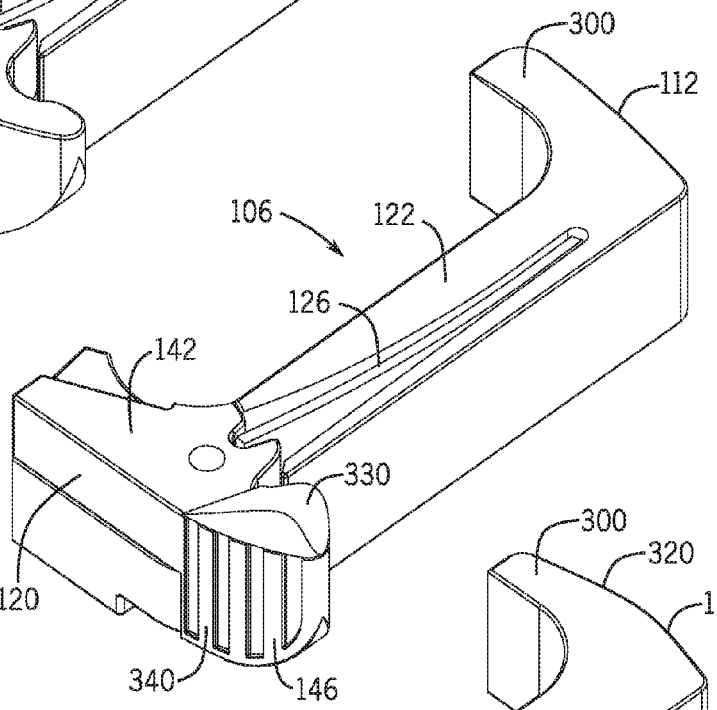
FIG. 12 is a perspective view of an additional magazine release assembly.
Figure 13:
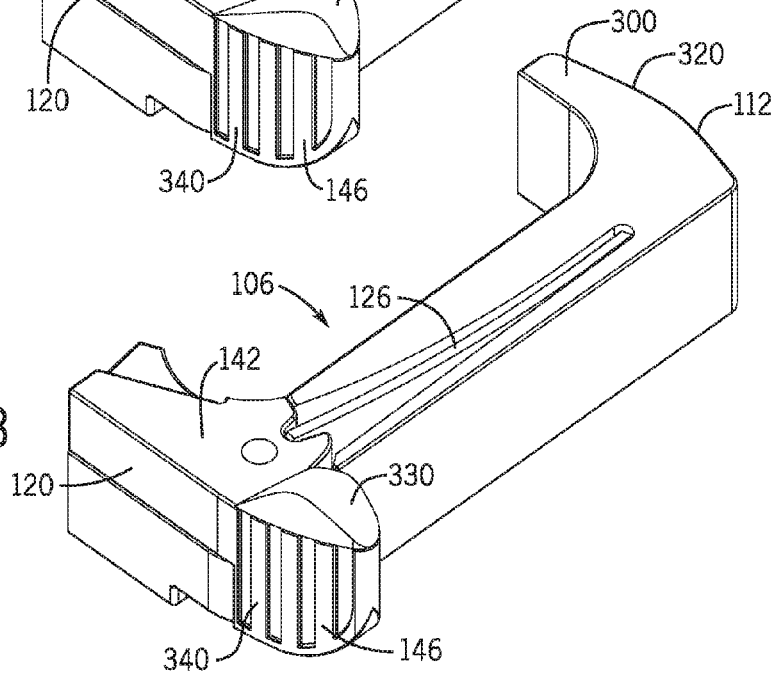
FIG. 13 is a perspective view of an additional magazine release assembly.

Additionally or alternatively, the lever 120 may be shaped and sized to achieve a desired aesthetic and/or functional characteristic. In one embodiment, the finger 146 of the lever 120 may be shaped to achieve a desired tactile feel. For instance, the finger 146 may be configured (e.g., enlarged or otherwise shaped) to provide a gripping feature arranged to facilitate the user actuating the magazine release 106. For example, the finger 146 may include a ridge 330 extending from the top surface 142 of the lever 120 (see FIGS. 12 and 13). The ridge 330 may be defined anywhere along the finger 146 (e.g., adjacent a terminal end of the finger 146 as shown in FIG. 12, or adjacent a middle portion of the finger 146 as shown in FIG. 13, among others) to provide a desired aesthetic and/or functional characteristic, such as matching the aesthetics of the lever 120 to the particular firearm and/or providing a desired touch point for the user based on personal preferences. In some embodiments, the finger 146 may include a plurality of surface features 340, such as ribs and/or grooves, defined thereon (see FIGS. 12 and 13). In such embodiments, the surface features 340 may be arranged to provide a desired friction between the finger 146 and the user's finger(s). For example, the surface features 340 may be operable to increase the amount of friction between the finger 146 and the user's finger(s) to achieve a desired tactile feel and/or limit the user's finger(s) from slipping off the lever 120.

Figure 14:
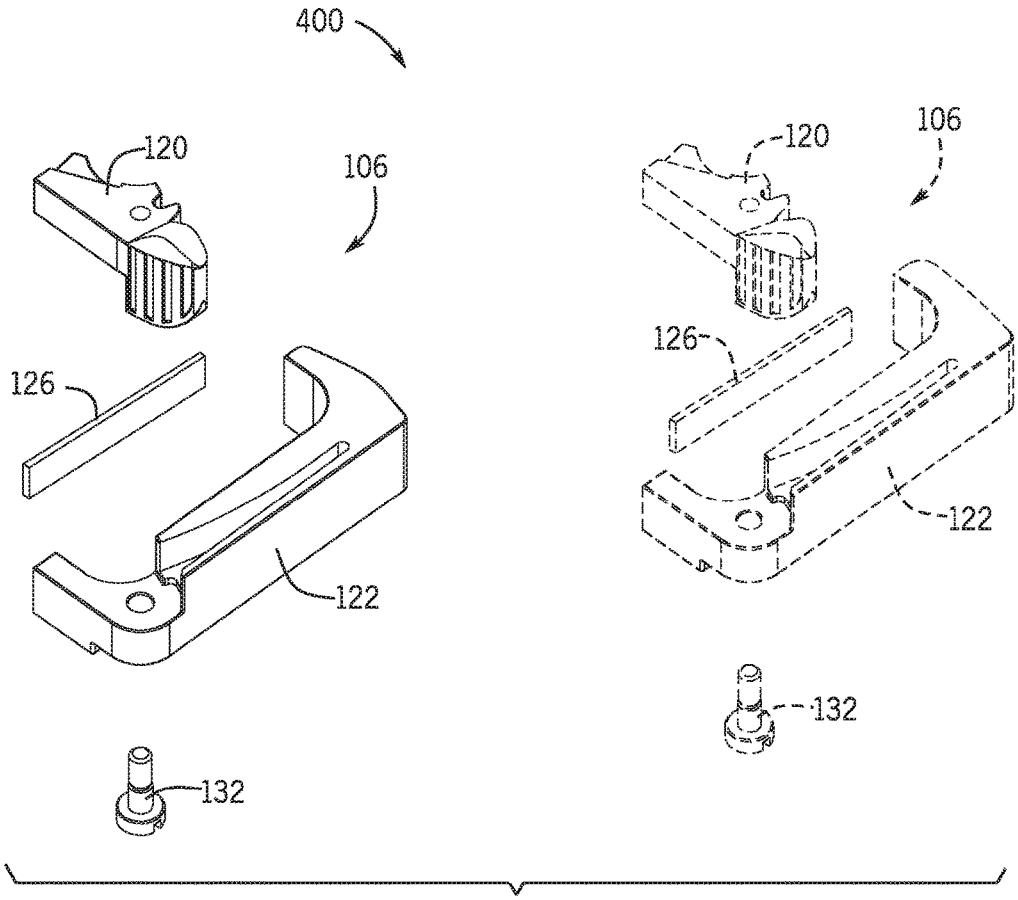
FIG. 14 is a perspective view of a kit providing one or more components of the magazine release assembly.

In some embodiments, the various components of the magazine release 106 may be provided in a kit 400 as an accessory for a firearm (see FIG. 14). For example, the kit 400 may include one or more release rods 122, one or more levers 120, one or more biasing members 126, and one or more fasteners 132, or any combination thereof. For instance, the kit 400 may include one release rod 122 sized to fit one model of firearm (e.g., a Gen 3 Glock pistol) and another release rod 122 sized to fit another model of firearm (e.g., a Gen 4 Glock pistol). Additionally or alternatively, the kit 400 may include a plurality of levers 120, each lever 120 sized and/or shaped differently depending on the model of firearm and/or the desired tactile feel of the user. In some embodiments, the kit 400 may be tailored to a particular firearm model. For example, the kit 400 may include a release rod 122, a lever 120, a biasing member 126, a fastener 132, or any combination thereof configured for a first firearm (e.g., a Gen 3 Glock pistol). In like manner, the kit 400 may include a release rod 122, a lever 120, a biasing member 126, a fastener 132, or any combination thereof configured for a second firearm (e.g., a Gen 4 Glock pistol). In each of the embodiments described above, the kit 400 may permit a user to customize the appearance and/or tactile characteristic of the magazine release 106 based on user preference.

It should be noted that while the present disclosure focuses on a release assembly for a Glock pistol, the methods and disclosure can be used in many other applications. In particular, the release assembly can be used with pistols of other manufacturers (e.g., Smith & Wesson, Heckler & Kock, SIG Sauer, or Springfield Armory, among others) as well as with other types of firearms (e.g., AR-type firearms or other firearms types utilizing a releasable magazine) to provide ambidextrous magazine release control. As such, the discussion of any particular embodiment is meant as illustrative only.

In methodologies directly or indirectly set forth herein, various steps and operations are described in one possible order of operation, but those skilled in the art will recognize the steps and operation may be rearranged, replaced or eliminated without necessarily departing from the spirit and scope of the present disclosure. It is intended that all matter contained in the above description or shown in the accompanying drawings shall be interpreted as illustrative only and not limiting. Changes in detail or structure may be made without departing from the spirit of the present disclosure as defined in the appended claims.

What is claimed is:

1. An ambidextrous magazine release for a firearm, comprising:

an integrally formed release rod configured to be operably coupled to the firearm, the release rod defining a channel;

a lever operably connected to the release rod and rotatable relative thereto, the lever including a catch, wherein a portion of the lever is configured to engage a magazine received within the firearm; and a biasing member coupled to the release rod and to the lever, wherein the biasing member is received within the channel of the release rod, such that a first end of the biasing member is secured within the release rod and a second end of the biasing member is received within the catch of the lever, wherein:

when a first force in a first direction is applied to the release rod, the release rod moves the lever to cause the lever to disengage the magazine; and when a second force in a second direction is applied to the lever, the lever rotates relative to the release rod to disengage the magazine, and when the second force is removed, the biasing member rotates the lever to an engagement position.

2. The ambidextrous magazine release of claim 1, wherein the first force is opposite in direction to the second force.

3. The ambidextrous magazine release of claim 1, wherein the biasing member comprises a first spring and a second spring.

4. The ambidextrous magazine release of claim 1, wherein the biasing member is a flat bar.

5. The ambidextrous magazine release of claim 1, wherein:

the lever comprises a finger accessible from a first side of the firearm;

the release rod comprises an actuator accessible from a second side of the firearm;

the first force is applied to the actuator; and the second force is applied to the finger.

6. The ambidextrous magazine release of claim 5, wherein the actuator includes a button extending from the release rod to define an enlarged engagement surface.

7. The ambidextrous magazine release of claim 1, wherein:

the release rod is configured to be operably coupled to a handle of the firearm; and the lever is configured to selectively engage a portion of the magazine received within the handle of the firearm.

8. The ambidextrous magazine release of claim 1, wherein the release rod comprises a spring channel that receives a release spring secured to the firearm.

9. The ambidextrous magazine release of claim 8, wherein engagement of the release spring to the release rod provides a biasing force against the first force.

10. An ambidextrous magazine release for a firearm, comprising:

an integrally formed release rod that extends from a first side of the firearm to an opposing second side of the firearm, the release rod including a groove defined therein;

a lever rotatably coupled to the release rod, the lever including a channel and an engagement feature selectively engaging a magazine received within a magazine well of the firearm; and a spring engaged with the release rod and the lever to bias the lever into engagement with the magazine, the spring received within the groove of the release rod such that a first end of the spring is captured within the release rod and a second end of the spring is received within the channel of the lever ;

wherein when a force is applied to either the release rod or the lever, the lever moves from a first position to a second position, disengaging the magazine and when the force is removed, the spring moves the lever from the second position to the first position.

11. The ambidextrous magazine release of claim 10, wherein:

when a first force in a first direction is applied to the release rod, the release rod moves the lever to cause the lever to disengage the magazine; and when a second force in a second direction is applied to the lever, the lever rotates relative to the release rod to disengage the magazine.

12. The ambidextrous magazine release of claim 11, wherein the lever rotates about a rotation axis, wherein the rotation axis is aligned with the channel of the lever.

13. The ambidextrous magazine release of claim 12, further comprising a fastener extending through the release rod and the lever to secure the lever to the release rod, wherein the fastener defines the rotation axis.

14. The ambidextrous magazine release of claim 10, further comprising a fastener pivotably coupling the lever to the release rod.

15. The ambidextrous magazine release of claim 10, wherein the channel of the lever is defined between two lobes.

16. The ambidextrous magazine release of claim 10, wherein the lever further comprises an interior surface shaped to substantially match the interior contours of the magazine well of the firearm.

17. The ambidextrous magazine release of claim 10, wherein the engagement feature comprises a tang that selectively extends into the magazine well of the firearm to be received within a catch defined in the magazine.

* * * * *